US006079138A

United States Patent [19]

Meaker

[11] Patent Number: 6,079,138

[45] Date of Patent: Jun. 27, 2000

[54] FOLDED DELAY BLOWBACK OPERATING SYSTEM FOR AUTOMATIC HAND HELD FIRING WEAPONRY

[76] Inventor: Donald L. Meaker, 839 W. Ave., L #19, Lancaster, Calif. 93534

[21] Appl. No.: 08/872,491

[22] Filed: Jun. 10, 1997

[51] Int. Cl.[7] ..... F41A 3/44

[52] U.S. Cl. ..... 42/17; 89/187.02

[58] Field of Search ..... 42/17, 20, 21; 89/187.02, 183, 188, 194, 197, 198, 130, 152, 153, 180

[56] References Cited

U.S. PATENT DOCUMENTS

| | | | |
|---|---|---|---|
| 3,101,648 | 8/1963 | Walther | 89/183 |
| 3,407,702 | 10/1968 | Cermak et al. | 89/194 |
| 3,738,219 | 6/1973 | Febres | 89/1.703 |
| 3,990,346 | 11/1976 | Irwin | 89/180 |
| 4,327,626 | 5/1982 | McQueen | 89/197 |
| 4,977,815 | 12/1990 | Stephens | 89/180 |
| 5,388,500 | 2/1995 | Petrovich | 89/194 |
| 5,447,092 | 9/1995 | Dobbins | 89/187.02 |
| 5,448,940 | 9/1995 | Schuetz | 89/185 |

FOREIGN PATENT DOCUMENTS

| | | | |
|---|---|---|---|
| 2326527 | 12/1974 | Germany | 89/187.02 |

*Primary Examiner*—Harold J. Tudor
*Assistant Examiner*—Christopher K. Montgomery

[57] ABSTRACT

An automatic firing system with military applications, that uses the existing state of the art delayed blowback locking mechanism dating from the 1940's. The difference is that the mechanism is located above and in front of the bolt rather than behind the bolt. When firing the weapon, the pressure from the discharge will push directly back on the bolt. The delay rollers apply enough pressure against the bolt to cause a delay before the bolt will move. Once the bolt begins to move it will push the delay rollers up against the delay cam and compression spring. The size and stiffness of the spring combine with the mass of the bolt, cam and rollers to determine the speed which the bolt will travel. The bolt will move back, away from the barrel, pulling the empty cartridge with it. While the bolt continues to move, it will pull the empty cartridge case to the ejection slot in the side of the stock receiver. The empty cartridge case is then ejected by conventional means. At the same time the empty cartridge case is ejected, the spring loaded magazine will push a new cartridge into the barrel opening. Once the empty cartridge is ejected, the delay cam and compression spring will push the bolt forward, contacting the new cartridge. The bolt will than push the new cartridge into the firing chamber and attach to the cartridge in a conventional manner.

3 Claims, 2 Drawing Sheets

FOLDED DELAY BLOWBACK OPERATING SYSTEM FOR AUTOMATIC HAND HELD FIRING WEAPONRY

BACKGROUND OF THE INVENTION

1. Field of the Invention

The present invention relates to rapidly firing automatic self loading weaponry with regard to a new locking delay mechanism using pressure caused from the force generated from the firing of the projectile.

2. Description of the Prior Art

By way of example, the prior art discloses in U.S. Pat. No. 5,338,500 to Petrovich a Delayed blow-back for firearms using the gas from the fired projectile to delay the departure of the gun bolt from the chamber or barrel zone.

U.S. Pat. No. 5,448,940 to Schuetz discloses a Gas operated M-16 pistol that utilizes the gases from the fired projectile to actuate the spring-biased buffer system.

U.S. Pat. No. 3,407,702 to Cermak/Novotny discloses a Retarded blow-back Breech Mechanism.

U.S. Pat. No. 3,101,648 to Walther discloses a Mechanism for maintaining a slow rate of firing.

In this respect, the folded delay blowback operating system for automatic weaponry according to the present invention substantially departs from the conventional concepts and designs of the prior art, and in doing so provides a folded delay blowback operating system that would enhance the size, handling weight, and accuracy of the automatic self loading weaponry.

My invention is an improvement for automatic firing and self loading weapons such as machine guns and automatic pistols. In such weapons, a delayed blowback locking mechanism has been used dating from the 1940's. The difference is that my mechanism is located above and in front of the bolt rather than behind the bolt as in current designs. Compared to similar products, when applied to a Bullpup military assault rifle, it would allow the rifle to be approximately 4 (four) inches shorter than other Bullpup rifles. When compared to other rifles with a delayed blow back action, the rifle could be approximately 10 (ten) inches shorter for a military rifle. This would not only make the weapon lighter it would be easier to handle within aircraft, vehicles, or buildings. The Folded Delay Blowback Operating System would be more reliable than other gas operated or delayed blowback rifles because the locking delay mechanism is separate from the combustion gases, and is distant from the magazine, ejection ports, and all sources of dirt and contamination. The shorter bolt behind the barrel gives potential for shorter, lighter firing pins for short lock time and higher accuracy.

SUMMARY OF INVENTION

My device is a folded delay blow-back operating system that is less complex than other devices used to delay blow-back. My device is composed of a bolt, part of which is located directly behind the barrel and firing chamber. The bolt is shaped such that the bolt travels along the top of the barrel and then upward. When the round is fired, the pressure from the discharge pushes the cartridge against the bolt. The bolt is made to travel along two slots in either side of the receiver. The bolt is in contact with two rollers recessed into the side of the receiver. These rollers are in contact with the cam and spring assembly. The inner indentation set in the side of the receiver is such that the force of the rollers applied against the bolt is about four times that of the forces of the compression spring applied against the cam. This leverage achieves the desirable delay in the motion of the bolt allowing the pressure in the barrel to reduce to safe levels.

DESCRIPTION OF THE PREFERRED EMBODIMENT

Figure 1:
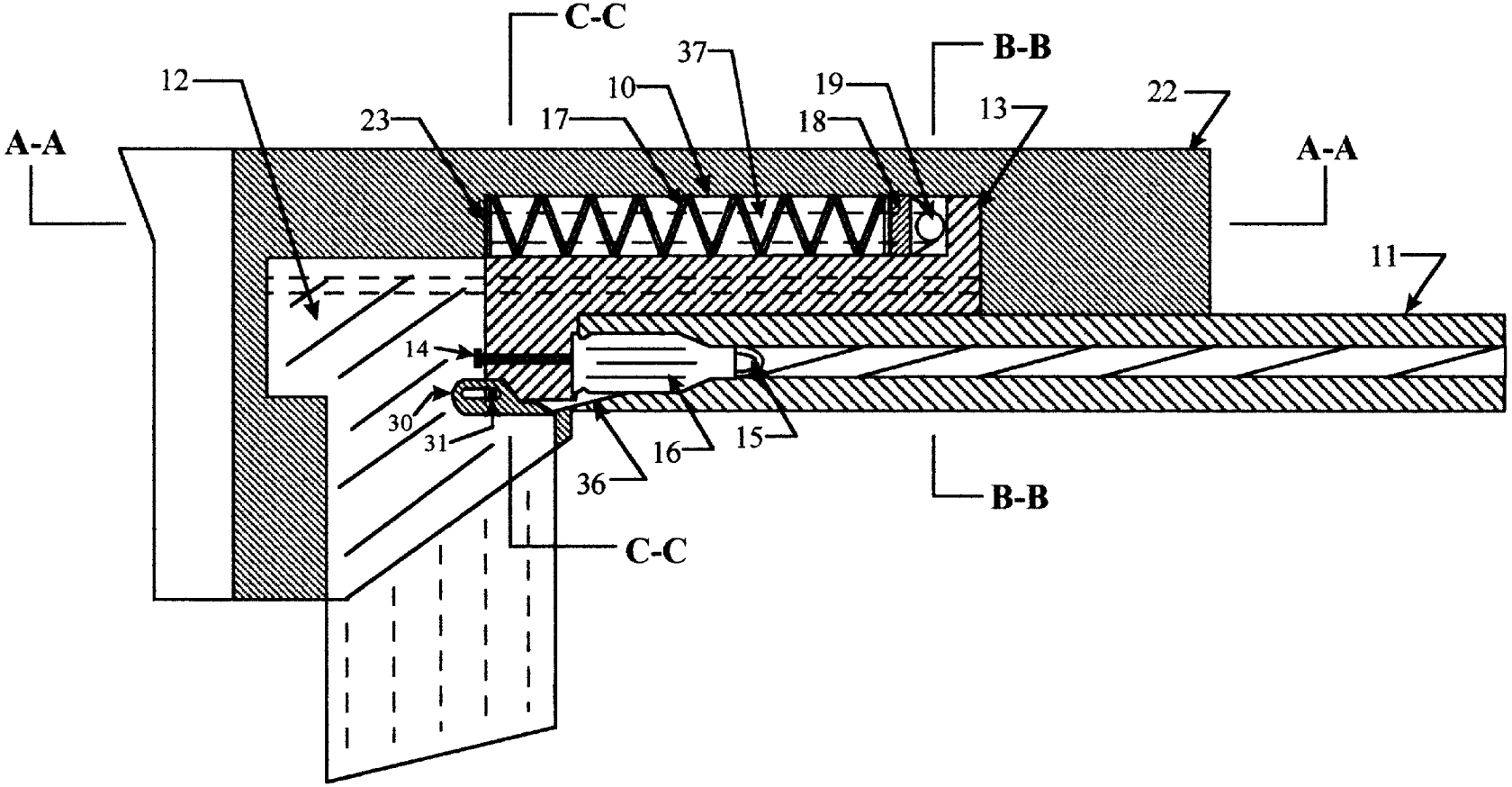
FIG. 1 is an axial sectional view of a gun barrel containing a gun chamber, a bolt and a embodiment of my folded delay blow-back device.
Figure 2:
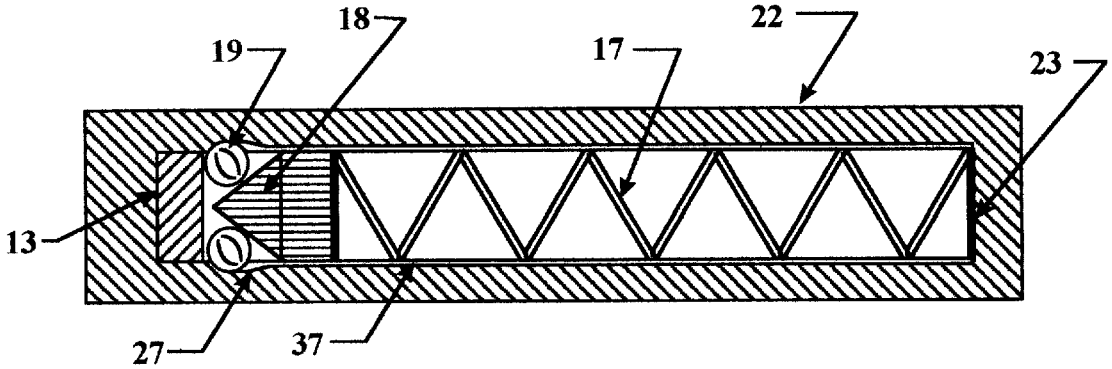
FIG. 2 is a sectional view taken along zone line A—A in FIG. 1

Referring first to FIG. 1 is a cross-sectional side view of a rifle with gun's folded delay blow-back mechanism 10 mounted to a barrel 11 directly above a firing chamber 12 containing a conventional bolt 13 and a conventional firing pin 14. Located in firing chamber 12 ahead of conventional bolt 13 and conventional firing pin 14 is a conventional projectile 34 having a bullet 15 and casing 16 filled with propellant.

Figure 3:
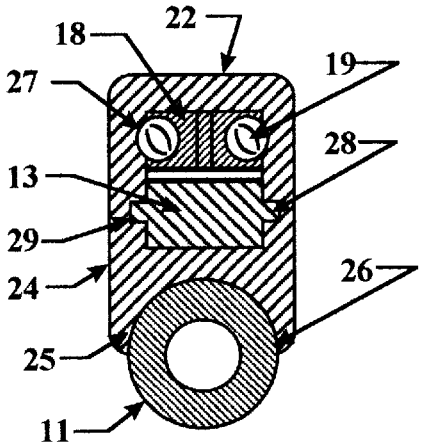
FIG. 3 is a sectional view taken along zone line B—B in FIG. 1

As shown in FIG. 1 and FIG. 3, there is attached to barrel 11 a receiver 22, whose essentially rectangular portion 24 is in any suitable way attached so as to permit removal of barrel 11 when required. Receiver 22 defines an outer concavity 25 that sealingly rides against a portion of outer diameter 26 of barrel 11. Located in receiver 22 is key way 29 one on either side of receiver 22. Bolt 13 has an elongated key 28 engaged in key way 29. Directly on top of bolt 13 in receiver 22 is located delayed action roller 19 set to rest in inner indentation 27 located in receiver 22. Indentation 37 has tapered end 27 so as to exert a cam action upon delayed action roller 19 in the inward direction. Located aft of delayed action roller 19 is roller cam 18 attached to operating spring 17 with operating spring 17 permanently affixed to receiver wall 23.

Figure 4:
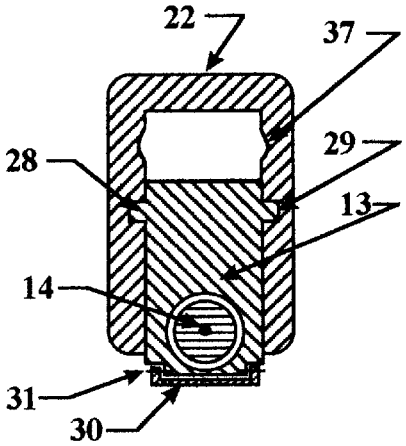
FIG. 4 is a sectional view taken along zone line C—C in FIG. 1
Figure 5:
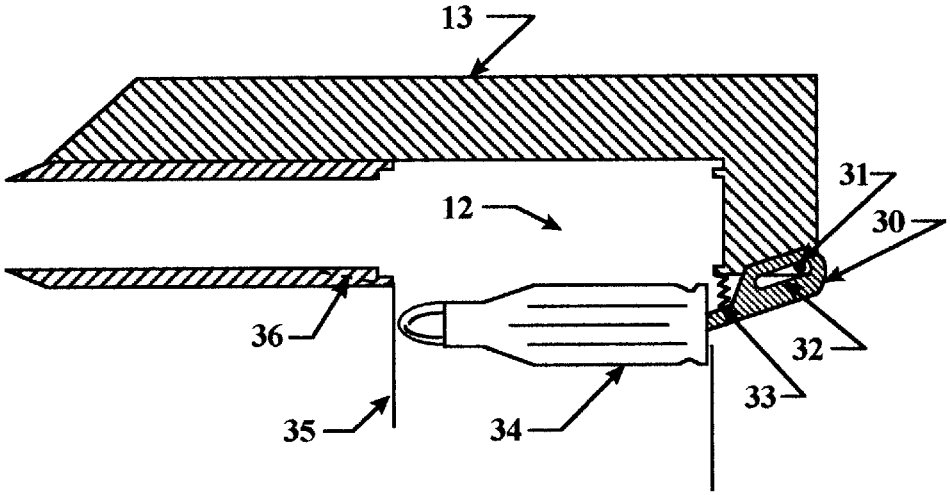
FIG. 5 is a side view of the firing chamber.

As shown in FIG. 4 and FIG. 5, located at bottom bolt 13 is feed plate 30 attached to bolt 13 by pin 31 applied through slot 32 in feed plate 30. Compression spring 33 applied pressure against feed plate 30 which in turn applies pressure against projectiles 34 in magazine 35. As bolt 13 moves aft upon discharge of projectile 34, projectile casing is ejected through ejection port in a conventional matter. Feed plate 30 slides along top projectile 34 in magazine 35. Compression spring 33 pushes feed plate 30 to drop behind projectile 34 in magazine 35. Firing chamber 12 back wall pushes feed plate 30 forward as bolt 13 completes travel aft. Feed plate 30 contacts aft end of projectile 34. Bolt 13 and feed plate 30 moves forward pushing projectile 34 into firing chamber 12. Firing chamber 12 has cam 36 to allow feed plate 30 to rest. Conventional magazine spring pushes new projectile 34 upward.

Operation of Folded Delay Blowback System is as follows

Firing pin 14 strikes projectile 34, the propellant therein explodes, driving bullet 15 through barrel 11. Force from propellant applies pressure to casing 16 and casing 16 in turn applies pressure against bolt 13. Bolt 13 remains stationary as the pressure so exerted is in turn applied to delay action rollers 19 in inter indentation 27 which cause delay in bolt 13 movement. Due to its own inertia, bolt 13 moves aft causing delay action rollers 19 to move inward out of inter indentation 27 contacting roller cam 18. Bolt 13, delay action rollers 19, and roller cam 18 slide aft along keyways 29 against operating spring 17.

As force from propellant pushes casing 16 aft against bolt 13, bolt 13 moves aft with feeder plate 30. Empty casing 16 is ejected through ejection slot in a conventional matter. While empty casing 16 is being ejected, feeder plate 30 engages back of new projectile 34 in magazine 35. Feeder plate 30 applies pressure against aft end of projectile 34 causing projectile 34 to be pushed up into firing chamber 12. Once new projectile 34 is fed into firing chamber 12, conventional spring in magazine pushes new projectile 34 upward.

Once pressure in barrel subsides, operating spring 17 applies pressure against roller cam 18 which in turn applies pressure against delay action rollers 19 which in turn applies pressure against bolt 13. Once empty casing 16 is ejected, aforementioned pressure moves delay action rollers 19 and bolt 13, along keyways 29 thus pushing projectile 34 in firing chamber 12 and delay action rollers 19 return to inter indentation 27.

I wish it to be understood that I do not desire to be limited to the exact details of construction or method shown herein since obvious modifications will occur to those skilled in the relevant arts without departing from the spirit and scope of the following claims. Therefor also be it known that this herein described Folded Delay Blowback Operating System should in no way be limited to the extent described herein and can be applied to any automatic firing and self loading weaponry.

What is claimed is:

1. In an automatic firing and self loading weapon having a receiver, a firing chamber, a barrel, and a bolt translatable to a position immediately behind a projectile before firing, an operating system to delay the movement of the bolt from the position behind the projectile, comprising:

a receiver defining a cavity therein, said receiver containing a roller delay mechanism comprising two inner indentations, one on either side, in front of two roller guides, wherein are located delay action rollers, roller cam and an operating spring which are in turn located atop and forward of the firing chamber; and said receiver defining a cavity therein with keyways to guide a bolt wherein said keyways are parallel to the center line of the barrel, below and behind the inner indentation and roller guides.

2. The operating system of claim 1, wherein the receiver further comprises:

said bolt located therein slideable along said keyways; and said bolt having two angled portions, a first angled portion located at a forward portion of, and above, said keyways;

wherein said first angled portion presses against said roller delay mechanism forward of the firing chamber, and a second angled portion is located at a rearward portion of, and below, said keyways, and further wherein said second angled portion presses against a projectile in the firing chamber, and said second angled portion has a retainer to accept a feed plate pressure spring and a hole to accept a feed plate attachment pin.

3. The operating system of claim 2 wherein the bolt further comprises:

said feed plate having an elongated slot to receive said attachment pin, allowing said feed plate to move downward when said bolt moves rearward; and a spring affixed to said bolt and applying pressure against said feed plate to push said feed plate down and forward when said bolt with said attachment pin moves rearward;

wherein said feed plate, said spring, and a camming surface are arranged so that a portion of the bolt located behind the firing chamber, when the bolt is in a closed position, is substantially shorter in length than the cartridge to be fired.

* * * * *